US006405657B1

(12) United States Patent
Polley

(10) Patent No.: US 6,405,657 B1
(45) Date of Patent: Jun. 18, 2002

(54) RAILWAY TRUCK WITH EQUALIZER BEAM MOUNTED DISC BRAKE CALIPER

(75) Inventor: Richard B. Polley, Gahanna, OH (US)

(73) Assignee: Buckeye Steel Castings Co., Columbus, OH (US)

( * ) Notice: Subject to any disclaimer, the term of this patent is extended or adjusted under 35 U.S.C. 154(b) by 0 days.

(21) Appl. No.: 09/774,321

(22) Filed: Jan. 31, 2001

Related U.S. Application Data

(60) Provisional application No. 60/183,198, filed on Feb. 17, 2000, and provisional application No. 60/179,229, filed on Jan. 31, 2000.

(51) Int. Cl.[7] ..... B61F 5/00

(52) U.S. Cl. ..... 105/194; 105/209; 188/212; 188/33

(58) Field of Search ..... 105/194, 209, 105/157.1, 182.1, 195, 218.1; 188/207, 212, 215, 33

(56) References Cited

U.S. PATENT DOCUMENTS 2,365,724 A 12/1944 Pflager
2,710,676 A 6/1955 McCormick

*Primary Examiner*—Mark T. Le
(74) *Attorney, Agent, or Firm*—Banner & Witcoff, Ltd.

(57) ABSTRACT

A disc brake assembly for a railway truck is provided. The truck includes at least two wheel axle sets and brake discs mounted to the wheel axle sets. Extending between the wheel axle sets is a longitudinally extending truck frame. Also extending between the wheel axle sets and supporting the truck frame via primary springs are equalizer beams that further extend beyond the wheel sets and through an opening in the truck frame. Disc brake calipers are mounted to the equalizer beams with the caliper engaging the brake discs of the wheel sets. The assembly results in the brake discs and calipers being unsprung. In other words, the brake discs and calipers do not move relative to each other.

12 Claims, 4 Drawing Sheets

FIG. 2
(PRIOR ART)
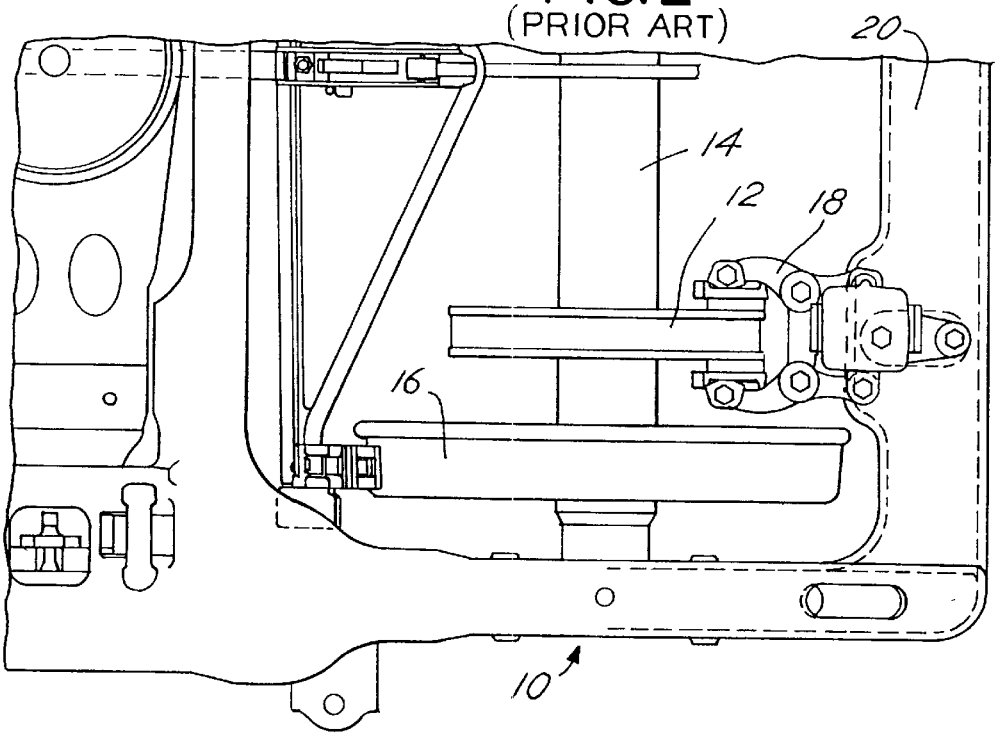
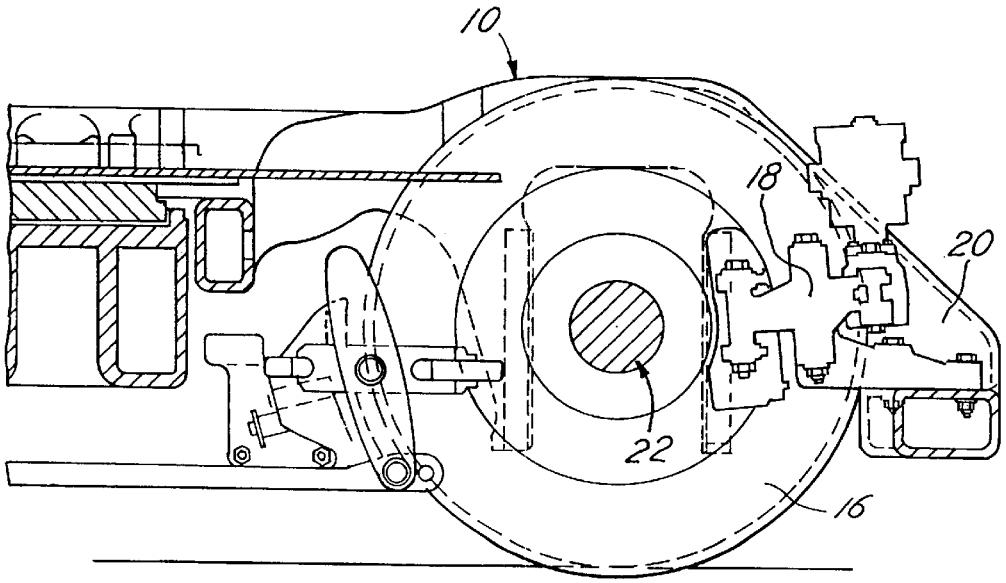
FIG. 1
(PRIOR ART)

RAILWAY TRUCK WITH EQUALIZER BEAM MOUNTED DISC BRAKE CALIPER

RELATED APPLICATIONS

This application claims the benefit of priority of U.S. Provisional Application No. 06/179,229 filed Jan. 31, 2000, and U.S. Provisional Application No. 60/183,198 filed Feb. 17, 2000, the disclosures of which are incorporated by reference.

BACKGROUND OF THE INVENTION

1. Field of the Invention

The present invention relates in general to improved brake assemblies for railway freight car trucks. More specifically, but without restriction to the particular use which is shown and described, this invention relates to the improved mounting of disc brake assemblies to the freight car truck.

2. Description of the Related Art

It is well known in the art to use disc brake assemblies as the braking mechanism for railway trucks, including passenger and freight car trucks. It is also known in the art that the disc brake assemblies include brake discs, disc brake calipers, and brake pads. In use, the brake discs are typically mounted on the truck wheel axle assembly, either directly to the axle or through the wheel. Under either mounting, the brake discs are unsprung. That is, the brake discs do not move relative to the wheel axle assembly.

The disc brake calipers are conventionally mounted on the truck frame and releasably engage the brake discs. Attached to the disc brake calipers are the brake pads which, in operation, contact the brake discs to provide a braking force to the wheels. Passenger and freight car trucks feature a primary suspension between the wheel axle assembly and the truck frame that allows relative vertical motion between the wheel axle assembly and the truck frame and accompanying disc brake calipers. Thus, the disc brake calipers are sprung relative to the wheel axle assembly and brake discs.

On passenger car trucks, this relative motion between the sprung brake calipers and unsprung brake discs has been limited by several design factors: loaded tare weight ratio is small on passenger trucks to minimize deflections due to static load change; the disc brake calipers conventionally have been located longitudinally inboard of the axle thereby limiting the deflection due to truck frame pitching; and a secondary suspension has been located between the truck frame and bolster to absorb the majority of vertical suspension deflection, thereby allowing the primary suspension to be stiffer. Taken together, these passenger car truck design factors have limited primary spring deflection sufficiently to accommodate sprung brake calipers and unsprung brake discs and has not resulted in the problems encountered by freight car trucks, discussed below.

As stated above, when a freight truck frame is mounted on a primary suspension, such as a primary spring, the disc brake caliper is sprung relative to the brake discs. During freight car operation, the sprung mounting of the caliper has resulted in an undesirable amount of relative vertical motion between the unsprung brake disc and the sprung brake caliper due to various conditions, such as, freight load, dynamic bounce and truck frame pitching. This undesirable relative vertical motion is amplified during high-speed operation of freight cars, which use softer primary springs to ensure safe operation and acceptable ride quality over existing track. The use of soft springs creates large spring deflections, which has been shown to create two common problems. First, the brake pads, which are part of the caliper assembly, can edge partially off of the disc, thereby reducing braking efficiency. Second, the brake pad reaction forces are transmitted through the brake caliper assembly to the truck frame. These reaction forces result in a pitching moment in the truck frame, which can unload individual primary springs. When the truck frame pitching is severe, individual springs may completely unload creating the possibility of unseating of the springs, or even losing springs from the truck assembly.

The present invention overcomes the aforementioned problems of excessive motion between the brake disc and caliper, and potential spring unloading.

SUMMARY OF THE INVENTION

The present invention is directed at eliminating the known problems associated with relative motion between the brake disc and caliper due to load conditions and other dynamic forces which develop during high speed freight car operation. The invention achieves these objectives by providing a disc brake assembly wherein the brake caliper is mounted to the equalizer beam, which is unsprung relative to the wheel axle assembly. With this construction, both the brake disc and brake caliper are unsprung members, and unsprung relative to each other. Because these members are unsprung, the relative displacement between the brake disc and caliper due to load variation, dynamic bounce, and braking-induced pitching is essentially eliminated. Moreover, the possibility of primary spring unloading is also eliminated.

BRIEF DESCRIPTION OF THE DRAWINGS

The invention will be described in relation to the accompanying drawings. In the drawings, the following figures have the following general nature:

FIG. 1 is a partial side view of a prior art truck assembly.

FIG. 2 is a partial top view of the prior art truck assembly of FIG. 1.

DESCRIPTION OF THE INVENTION

Figure 4:
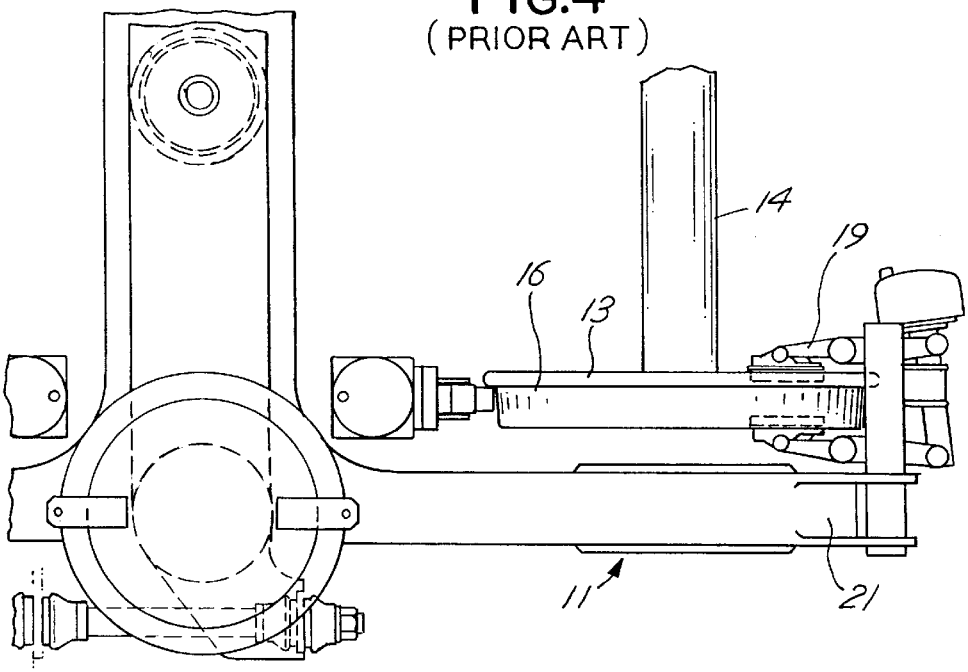
FIG.4 (PRIOR ART)
FIG. 4 is a partial top view of the prior art truck assembly of FIG. 3.
Figure 3:
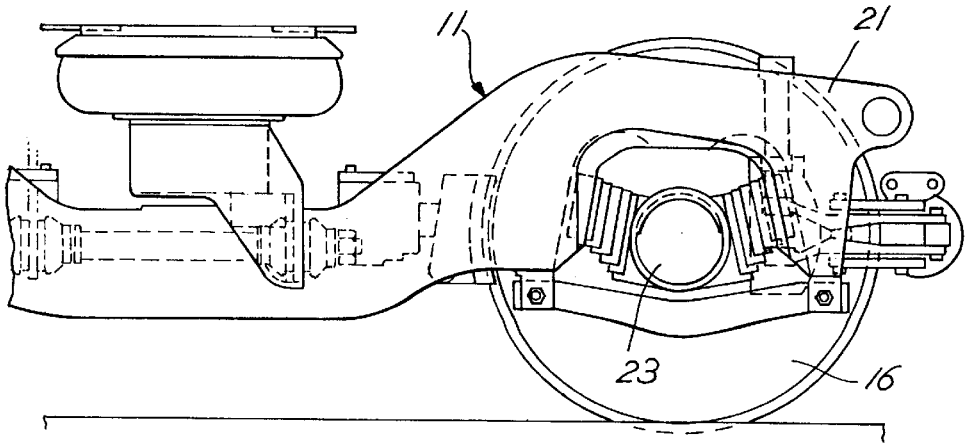
FIG.3 (PRIOR ART)
FIG. 3 is a partial side view of another prior art truck assembly.

Referring to the drawings wherein like numerals indicate like elements, there is shown in FIGS. 1–4 prior art truck assemblies which illustrate the sprung mounting of a disc brake caliper relative to the brake disc. As illustrated, the truck assemblies 10 and 11, as shown in FIGS. 1 and 3, respectively, include truck brake discs 12 and 13 which are mounted on the axle assembly, either directly to the axle 14, as depicted in FIGS. 1 and 2, or through the wheel 16, as depicted in FIGS. 3 and 4. Under either mounting, the brake discs are unsprung and therefore do not move relative to the wheel assembly. The truck assemblies also include disc brake calipers 18 and 19 which are mounted to the truck frame 20 and 21. The truck frame, in turn, is mounted to the wheel axle assembly 22 and 23 via a primary suspension. With this arrangement, the disc brake calipers are sprung, or move vertically relative to the wheel assembly during operation. It has been shown that, during operation, these prior art assemblies, wherein the caliper is sprung relative to the discs, have resulted in undesirable relative vertical motion between the unsprung disc and the sprung caliper due to load conditions, dynamic bounce and truck frame pitching. In some instances, for truck assemblies that use soft primary springs, the relative vertical motion can be such that the brake pads will edge partially off the disc, thereby reducing braking efficiency, and can be so extreme the primary springs can unseat or be lost from the truck assembly.

Figure 6:
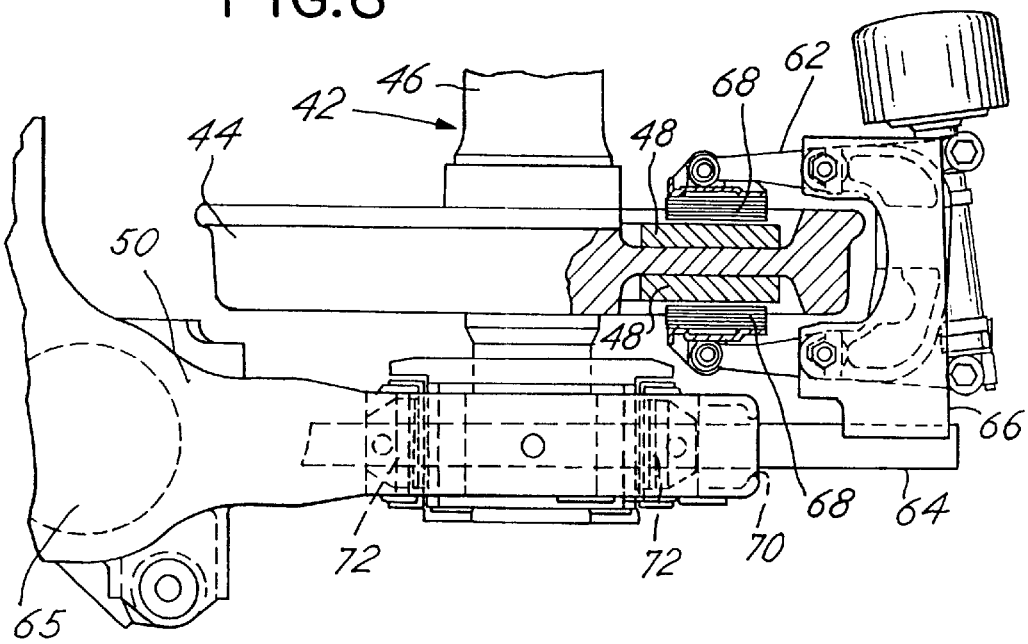
FIG. 6 is a partial top view of the invention of FIG. 5.
Figure 5:
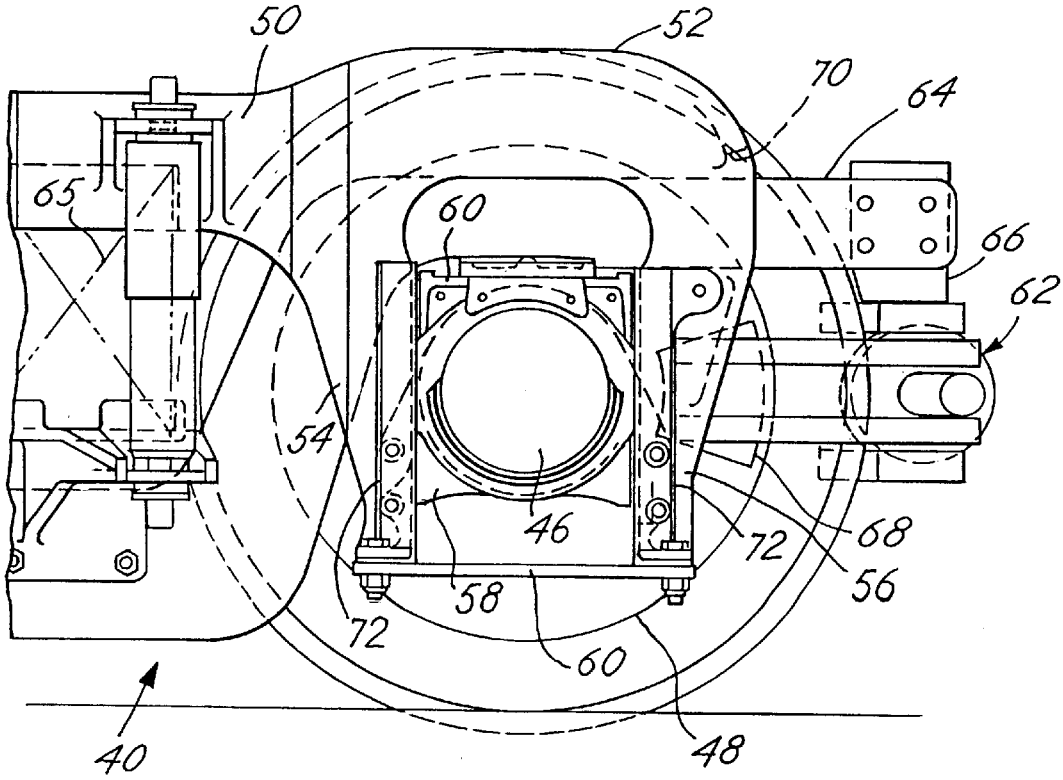
FIG. 5 is a partial side view of the truck assembly of the present invention.

Referring to FIGS. 5 and 6, the present invention is depicted and overcomes the problems of relative motion between the brake disc and caliper. As depicted in an exemplary embodiment, the present invention includes the truck assembly 40, which incorporates the inventive disc brake assembly, described below. The truck assembly 40 further includes wheel axle sets 42, comprising flanged railway wheels 44, spaced transversely from each other, and joined by a transversely extending axle 46. Mounted to the wheels 44 are the brake discs 48. It should be understood by those skilled in the art that the present invention may be used with brake discs mounted to the wheels or to the axles. Truck frame 50 is supported on the wheel sets through equalizer beams 64 and primary springs 65. As conventional, the truck frame 50 is longitudinally elongated and defines longitudinally spaced, downwardly opening pedestal jaws 52. The pedestal jaws define an inner pedestal leg 54 and an outer pedestal leg 56. Mounted between the inner and outer pedestal legs, within the opening of the pedestal jaws, are axleboxes 58 which rotatably receive the axles 46 through journal bearings. The axleboxes 58 are retained between the inner and outer pedestal legs via tie bars 60.

The truck 40 further comprises a disc brake caliper 62, which is mounted to an equalizer beam 64 via a mounting bracket 66. It will be understood by those skilled in the art that the mounting of the disc brake caliper 62 via the mounting bracket 66 may be accomplished by numerous methods of attachment, including the use of bolts, rivets, weld, or other suitable methods. Attached to the disc brake caliper 62 are brake pads 68 which, in operation, engage the brake discs 48 of the railcar wheels. In an exemplary embodiment, the equalizer beam 64 extends between the wheel sets and longitudinally beyond the axleboxes through an opening or core hole 70 in the outer pedestal leg 56 of the pedestal jaw 52. It should be understood by those skilled in the art that other designs of the equalizer beam are possible. Removable filler blocks 72 are located on all four inner pedestal legs to allow assembly and/or disassembly of the extended equalizer beam 64. On single equalizer beam truck designs the equalizer beams extend longitudinally between axleboxes and are transversely located on the journal centerlines passing between the inside and outside faces of the inner pedestal legs, one on each side of the truck. The filler blocks 72 are removable solid blocks fastened between the inside and outside faces of a split pedestal leg after the equalizer beam is installed to structurally replace material removed from the split pedestal leg to permit assembly/disassembly of the equalizer beam into the truck frame. Typically, filler blocks are required at one end of each of the truck frame and are secured by rivets on threaded fasteners. Due to the extended length of the equalizer beam, to mount the disc brake calipers in the present invention, the filler blocks are required at all four inner pedestal legs to facilitate installation and removal of the equalizer beams.

Figure 7:
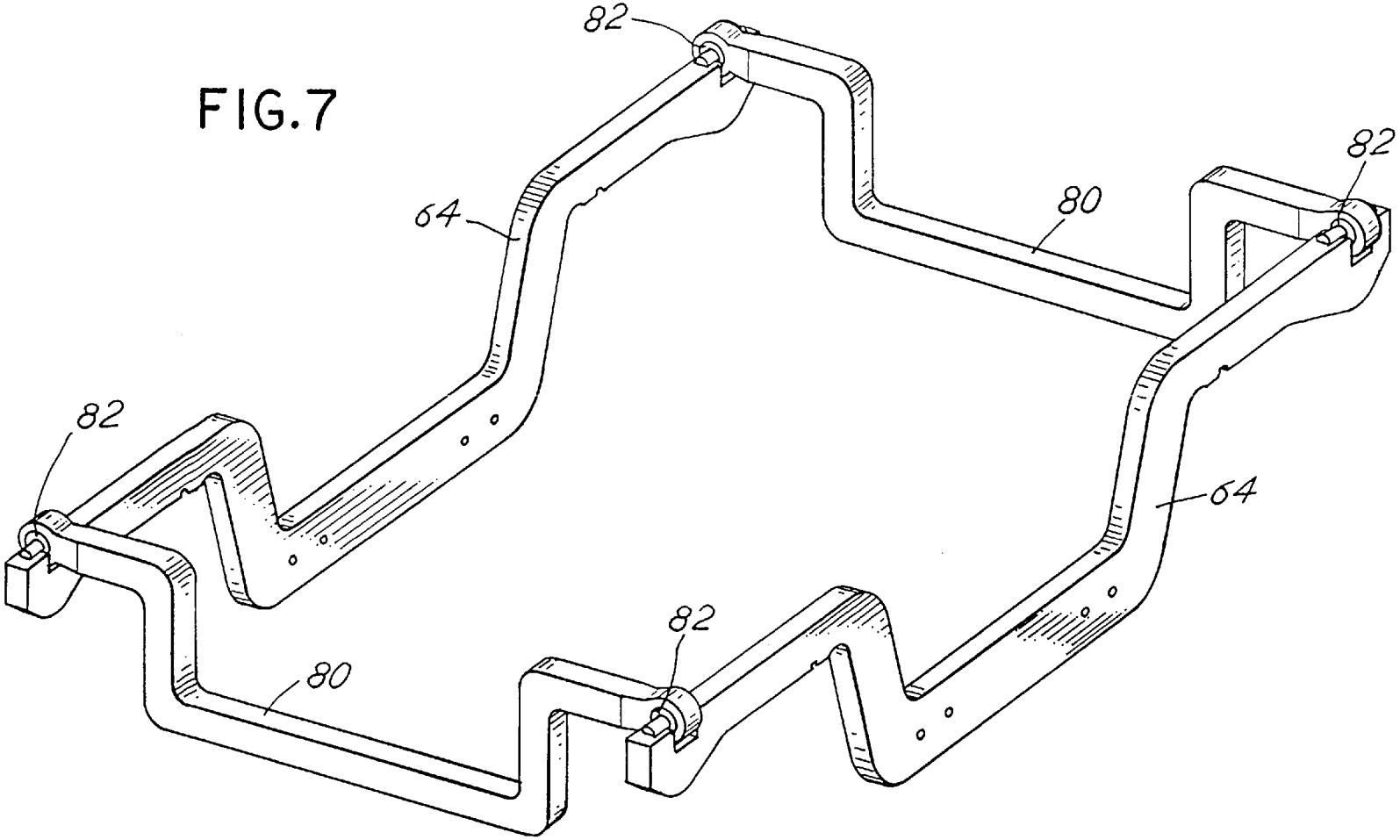
FIG. 7 is an isometric view of a pair of equalizer beams of the present invention connected to a pair of disc brake mounting beams.

Referring to FIG. 7, an alternative embodiment of the invention includes the use of disc brake mounting beams 80 which connect to and traverse opposing equalizer beams 64 to provide an alternative disc brake caliper mounting arrangement. The disc brake mounting beam, at its end, is pivotally mounted to a corresponding end of the equalizer beam 64. The mounting may be accomplished through the use of elastomeric bushings 82 or other similar methods of mounting which allow limited relative angular motion of the two equalizer beams on opposite sides of the truck. With this construction, the disc brake calipers may be mounted to the disc brake mounting beam 80.

Significantly, as assembled, the brake disc and caliper, and accompanying brake pads, are unsprung members. This unique assembly significantly, if not completely, eliminates the relative displacement between the brake disc and caliper due to load variation, dynamic bounce, and braking-induced pitching. In addition, the possibility of primary spring unloading is eliminated.

It should be understood that variations of the embodiments are possible without being outside the scope of the present invention. Therefore, to particularly point out and distinctly claim the subject matter regarded as the invention, the following claims conclude the specification.

What is claimed is:

1. A railway vehicle truck assembly comprising:

at least two longitudinally spaced, transversely extending axles, wheels mounted to the axles, brake discs mounted to the wheels, transversely spaced longitudinally extending truck frames defining downwardly extending pedestal jaws which are mounted to axleboxes that are mounted to the axles, a pair of equalizer beams mounted on opposing sides of the truck assembly, each of the equalizer beams having opposing distal ends, the distal ends of the equalizer beams extending longitudinally beyond the axleboxes and through an opening in the pedestal jaw, at least one disc brake mounting beam extending between the pair of equalizer beams, a disc brake caliper assembly mounted to the equalizer beam at the distal end of the equalizer beam, the disc brake caliper assembly including a caliper that engages one of the the brake discs of the wheels, filler blocks mounted to pedestal legs of the pedestal jaws, whereby said one of the brake discs and the caliper are unsprung relative to each other.

2. The railway vehicle truck assembly of claim 1 further comprising a mounting bracket, the disc brake caliper assembly being mounted to the mounting bracket.

3. The railway vehicle truck assembly of claim 2 wherein two disc brake mounting beams extend between the pair of equalizer beams.

4. A railway vehicle truck assembly having at least two wheel sets, brake discs mounted to the wheel sets, transversely spaced longitudinally extending truck frames mounted to the wheel sets, the truck frames defining an inner and outer pedestal legs, at least one equalizer beam extending between the wheel sets, the at least one equalizer beam having opposing distal ends, the distal ends of the equalizer beam extending longitudinally beyond the wheel sets and through a core hole in the outer pedestal leg of the truck frame, and a disc brake caliper mounted to the distal end of the equalizer beams the caliper engaging one of the brake discs of the wheel sets, whereby said one of the brake discs and the caliper do not move relative to each other.

5. The railway vehicle truck assembly of claim 4 further comprising a mounting bracket, the disc brake caliper being mounted to the mounting bracket.

6. The railway vehicle truck assembly of claim 5 wherein two equalizer beams are mounted on opposing sides of the truck assembly.

7. The railway vehicle truck assembly of claim 6 further comprising a disc brake mounting beam extending between the two equalizer beams, wherein the disc brake caliper is mounted to the disc brake mounting beam.

8. The railway vehicle truck assembly of claim 6 further comprising two disc brake mounting beams extending between the two equalizer beams.

9. The railway vehicle truck assembly of claim 6 further comprising filler blocks mounted to the truck frame.

10. A railway vehicle truck assembly comprising:

at least two wheel sets, brake discs mounted to the wheel sets, a truck frame mounted to the wheel sets, the truck frame defining an opening, a pair of equalizer beams mounted on opposing sides of the truck assembly and extending longitudinally beyond the wheel sets and through the opening in the truck frame, at least one filler block located within the opening in the truck frame, and a disc brake caliper mounted to the equalizer beam, the disc brake caliper engaging one of the brake discs, whereby said one of the brake discs and the caliper are unsprung relative to each other.

11. The railway vehicle truck assembly of claim 10 further comprising a mounting bracket, the disc brake caliper being mounted to the mounting bracket.

12. The railway vehicle truck assembly of claim 11 further comprising a disc brake mounting beam extending between the two equalizer beams.

* * * * *